US012016388B2

(12) United States Patent
Batista et al.

(10) Patent No.: US 12,016,388 B2
(45) Date of Patent: Jun. 25, 2024

(54) AEROSOL-GENERATING DEVICE WITH MOVABLE TOP COVER

(71) Applicant: PHILIP MORRIS PRODUCTS S.A., Neuchatel (CH)

(72) Inventors: Rui Nuno Batista, Morges (CH); Edward Kiernan, Le Mont-sur-Lasanne (CH)

(73) Assignee: Philip Morris Products S.A., Neuchatel (CH)

( * ) Notice: Subject to any disclaimer, the term of this patent is extended or adjusted under 35 U.S.C. 154(b) by 469 days.

(21) Appl. No.: 17/422,798

(22) PCT Filed: Jan. 15, 2020

(86) PCT No.: PCT/EP2020/050912
§ 371 (c)(1),
(2) Date: Jul. 14, 2021

(87) PCT Pub. No.: WO2020/148334
PCT Pub. Date: Jul. 23, 2020

(65) Prior Publication Data

US 2022/0125109 A1 Apr. 28, 2022

(30) Foreign Application Priority Data

Jan. 15, 2019 (EP) ..... 19151920

(51) Int. Cl.
*A24F 40/46* (2020.01)
*A24F 40/42* (2020.01)
(Continued)

(52) U.S. Cl.
CPC ..... *A24F 40/46* (2020.01); *A24F 40/42* (2020.01); *A24F 40/53* (2020.01); *A24F 40/85* (2020.01)

(58) Field of Classification Search
CPC ..... A24F 40/46; A24F 40/85; A24F 40/53; A24F 40/42
(Continued)

(56) References Cited

U.S. PATENT DOCUMENTS 7,726,320 B2 * 6/2010 Robinson ..... A24B 15/12 131/194
9,499,332 B2 11/2016 Fernando
(Continued)

FOREIGN PATENT DOCUMENTS

CN 107594622 1/2018
CN 107594638 1/2018
(Continued)

OTHER PUBLICATIONS

PCT Search Report and Written Opinion for PCT/EP2020/050912 dated Apr. 8, 2020 (8 pages).
(Continued)

*Primary Examiner* — Abdullah A Riyami
*Assistant Examiner* — Vladimir Imas
(74) *Attorney, Agent, or Firm* — Mueting Raasch Group

(57) ABSTRACT

The invention relates to an aerosol-generating device comprising a main body and a top cover. The top cover comprises a cavity configured for insertion of an aerosol-generating article comprising aerosol-forming substrate into the cavity. The device further comprises an ejector. The top cover is movable between a first position and a second position with respect to the main body. In the first position, the top cover is extended from the main body and the cavity is accessible for insertion of an aerosol-generating article. In the second position, the top cover is retracted towards the main body and the cavity is closed. The ejector is configured to eject an aerosol-generating article from the cavity during movement of the top cover from the first position to the
(Continued)

second position. The invention also relates to a system comprising an aerosol-generating device and an aerosol-generating article. The invention also relates to a method for ejecting an aerosol-generating article from an aerosol-generating device.

15 Claims, 16 Drawing Sheets

(51) Int. Cl.
*A24F 40/53* (2020.01)
*A24F 40/85* (2020.01)

(58) Field of Classification Search
USPC ..... 131/329
See application file for complete search history.

(56) References Cited

U.S. PATENT DOCUMENTS

| | | | | |
|---|---|---|---|---|
| 9,883,700 | B2 * | 2/2018 | Holzherr | A24F 9/16 |
| 10,327,477 | B2 * | 6/2019 | Silvestrini | F22B 1/284 |
| 10,328,443 | B2 * | 6/2019 | Ricketts | B05B 11/0054 |
| 10,701,983 | B2 * | 7/2020 | Silvestrini | A24F 40/42 |
| 10,786,007 | B2 * | 9/2020 | Hogwood | A61M 15/0021 |
| 11,272,578 | B2 * | 3/2022 | Robert | H05B 3/44 |
| 11,297,877 | B2 * | 4/2022 | Zinovik | F16K 7/06 |
| 11,297,882 | B2 * | 4/2022 | Holzherr | H02J 7/0044 |
| 11,590,301 | B2 * | 2/2023 | Cross | A61M 11/042 |
| 11,696,368 | B2 * | 7/2023 | Silvestrini | H05B 1/0227 131/329 |
| 11,805,815 | B2 * | 11/2023 | Lee | A61M 11/042 |
| 2014/0190496 | A1 * | 7/2014 | Wensley | A61M 11/042 131/273 |
| 2018/0242642 | A1 * | 8/2018 | Silvesstrini | H05B 1/0227 |

FOREIGN PATENT DOCUMENTS

| | | |
|---|---|---|
| CN | 108 158 043 | 6/2018 |
| CN | 207927770 | 10/2018 |
| CN | 108 783 601 | 11/2018 |
| RU | 2531890 | 10/2014 |
| WO | WO 2016/124550 | 8/2016 |
| WO | WO 2017/029089 | 2/2017 |

OTHER PUBLICATIONS

Office Action issued in Russia for Application No. 2021120498 dated Nov. 22, 2021 (7 pages). English translation included.
Office Action issued in China for Application No. 2020800006919.5 dated Dec. 6, 2023 (14 pages). English translation included.

* cited by examiner

AEROSOL-GENERATING DEVICE WITH MOVABLE TOP COVER

This application is a U.S. National Stage Application of International Application No. PCT/EP2020/050912 filed Jan. 15, 2020, which was published in English on Jul. 23, 2020, as International Publication No. WO 2020/148334 A1. International Application No. PCT/EP2020/050912 claims priority to European Application No. 19151920.6 filed Jan. 15, 2019.

The present invention relates to an aerosol-generating device, an aerosol-generating system and a method for ejecting an aerosol-generating article from an aerosol-generating device.

BACKGROUND

It is known to provide an aerosol-generating device for generating an inhalable vapor. Such devices may heat an aerosol-forming substrate without burning the aerosol-forming substrate. Such aerosol-forming substrates may be provided as part of an aerosol-generating article. Such devices may be arranged to receive an aerosol-generating article comprising an aerosol-forming substrate. The aerosol-generating article may have a rod shape for insertion of the aerosol-generating article into a cavity of the aerosol-generating device. A heater may be arranged in or around the cavity for heating the aerosol-forming substrate when the aerosol-generating article is inserted into the cavity of the aerosol-generating device. After aerosol generation, the aerosol-generating article has to be removed from the cavity. During removal, unwanted residues of aerosol-forming substrate may stick to the heater or to the walls of the cavity. Conventional aerosol-generating devices thus have to be regularly cleaned.

It would be desirable to have an aerosol-generating device which does not need cleaning or in which the necessity for cleaning is reduced.

SUMMARY

The above mentioned and further objects of the invention are achieved by an aerosol-generating device comprising a main body and a top cover. The top cover comprises a cavity configured for insertion of an aerosol-generating article comprising aerosol-forming substrate into the cavity. The device further comprises an ejector. The top cover is movable between a first position and a second position with respect to the main body. In the first position, the top cover is extended from the main body and the cavity is accessible for insertion of an aerosol-generating article. In the second position, the top cover is retracted towards the main body and the cavity is closed. The ejector is configured to eject an aerosol-generating article from the cavity during movement of the top cover from the first position to the second position.

By providing a movable top cover with a cavity, the top cover may be used for automatically ejecting spent aerosol-generating articles. No further ejection element may be necessary. The ejecting action may be facilitated by a user using a single hand. In this regard, the device may be operated in the first position of the top cover, in which the top cover is in an extended state. In this position, an aerosol-generating article can be inserted into the cavity of the top cover. The cavity of the top cover is preferably configured as a heating chamber of the aerosol-generating device. After insertion of the aerosol-generating article into the cavity, the aerosol-generating article may be heated to generate an inhalable aerosol. When the aerosol-forming substrate of the aerosol-generating article is spent, the top cover may be pushed towards the main body so that the top cover is moved from the first position towards the second position. In the second position, the top cover is retracted towards the main body. During this movement, the ejector may eject the spent aerosol-generating article from the cavity. The cavity of the top cover is closed in the second position so that no aerosol-generating article can be inserted into the cavity, when the top cover is in the second position.

Consequently, an aerosol-generating device is provided which is operational in the first position of the top cover. By configuring the cavity as being closed in the second position, unwanted contamination of the cavity from outside is prevented. Preferably, the ejector is configured to automatically clean one or more of the heater and the walls of the cavity during movement of the top cover from the first position to the second position. No further cleaning element may be necessary.

DESCRIPTION

The main body and the top cover may be separate elements. The top cover may be held by corresponding elements of the main body such that the top cover may be moved with respect to the main body but not fully detached from the main body. The ejector and the main body may be separate elements. The ejector and the top cover may be separate elements. The ejector may be configured to be movable with respect to the top cover. The ejector may be configured to be movable with respect to the main body. The ejector may be held by corresponding elements of one or more of the main body and the top cover such that the ejector may not be fully detached from the main body on the top cover.

The term 'closed' may refer to a state in which an aerosol-generating article cannot be inserted into the cavity. Preferably, as will be described in detail below, during movement of the top cover from the first position to the second position, the ejector is pushed into the cavity, thereby ejecting an aerosol-generating article in the cavity. In the second position of the top cover, preferably the ejector essentially occupies the space of the cavity such that an aerosol-generating article cannot be inserted into the cavity.

The movable top cover may be slidably connected with the main body. The top cover may be arranged slidable along the longitudinal axis of the aerosol-generating device. Preferably, the longitudinal axis of the aerosol-generating device is identical to the longitudinal axis of the main body. Preferably, the longitudinal axis of the aerosol-generating device is identical to the longitudinal axis of the top cover. The aerosol-generating device may be configured such that the maximum expansion of the top cover with respect to the main body is in the first position. In other words, the aerosol-generating device may be configured such that the top cover can only be extended so far from the main body as to be positioned in the first position. Again in other words, the aerosol-generating device may be configured such that the top cover cannot be fully disengaged from the main body and only extended from the main body towards the first position.

The cavity may comprise a heater. The heater may comprise an electrically resistive material. Suitable electrically resistive materials include but are not limited to: semiconductors such as doped ceramics, electrically conductive ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The heater may be part of an aerosol-generating device. The aerosol-generating device may comprise an internal heater or an external heater, or both internal and external heaters, where "internal" and "external" refer to the aerosol-forming substrate. An internal heater may take any suitable form. For example, an internal heater may take the form of a heating blade. Preferably, the internal heater is arranged within the cavity, more preferably centrally within the cavity. Alternatively, the internal heater may take the form of a casing or substrate having different electro-conductive portions, or an electrically resistive metallic tube. Alternatively, the internal heater may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heater may be deposited in or on a rigid carrier material. In one such embodiment, the electrically resistive heater may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heaters during operation.

An external heater may take any suitable form. For example, an external heater may take the form of one or more flexible heating foils on a dielectric substrate, such as polyimide. The flexible heating foils can be shaped to conform to the perimeter of the cavity. Preferably, the external heater is arranged surrounding the cavity. Alternatively, an external heater may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heater may also be formed using a metal having a defined relationship between temperature and resistivity. In such an exemplary device, the metal may be formed as a track between two layers of suitable insulating materials. An external heater formed in this manner may be used to both heat and monitor the temperature of the external heater during operation.

The heater advantageously heats the aerosol-forming substrate by means of conduction. The heater may be at least partially in contact with the substrate, or the carrier on which the substrate is deposited. Alternatively, the heat from either an internal or external heater may be conducted to the substrate by means of a heat conductive element. The heater may also be configured as an induction heater. In this case, the heater may comprise susceptor material and an induction coil arranged surrounding the susceptor material. Preferably, the susceptor material has the form of a blade or pin is arranged as an internal heater, while the induction coil is arranged surrounding the susceptor material.

The heater may be part of the main body. Preferably, however, the heater is part of the top cover. Hence, the heater is preferably moved together with the top cover. In the first position, the heater may be extended from the main body.

During operation, an aerosol-generating article containing the aerosol-forming substrate may be partially contained within the aerosol-generating device. In that case, the user may puff directly on the aerosol-generating article.

The cavity preferably has a cylindrical shape. The cavity preferably has a base. The base preferably has an opening, through which the heater may pass. The cavity may comprise a proximal end. The proximal end may be open for insertion of an aerosol-generating article. The cavity may comprise a distal end opposite the proximal end. The distal end may comprise the base of the cavity. Alternatively, the cavity may have an open distal end. In this case, the cavity may not comprise a base. In this case, the cavity may be tubular. A proximal end of the ejector may be arranged to be adjacent the distal end of the cavity, if the top cover is in the first position. Then, an aerosol-generating article may be inserted into the cavity until the aerosol-generating article abuts the proximal end of the ejector at the distal end of the cavity. After the movement of the top cover from the first position to the second position, the proximal end of the ejector may be arranged near the proximal end of the cavity. Hence, in the second position, the cavity may be closed by the proximal end of the ejector. The proximal end of the ejector may be planar. The proximal end of the ejector may comprise an opening, through which the heater may pass. The heater may extend through the opening when the top cover is in the first position. The heater may be partially or fully retracted through the opening when the top cover is in the second position. The heater may thus be protected from damage during ejection of the aerosol-generating article.

As used herein, the terms 'upstream', 'downstream', 'proximal' and 'distal' are used to describe the relative positions of components, or portions of components, of the aerosol-generating device in relation to the direction in which a user draws on the aerosol-generating device or an aerosol-generating article during use thereof.

The cavity may have any desired shape. The cavity may have a cylindrical or tubular shape. Preferably, the cavity has a cross-section corresponding to the cross-section of the aerosol-generating article to be used with the aerosol-generating device. For example, the cavity may have a cross-section to enable a keyed configuration, meaning that aerosol-generating articles may only be inserted in a specific way into the cavity.

The ejector is preferably configured movable with respect to the main body or the top cover or preferably the main body and the top cover.

The aerosol-generating device may further comprise at least one first biasing element, preferably a first spring, for biasing the top cover towards the first position.

The aerosol-generating device may comprise at least one protruding element attached to the top cover and accessibly arranged on the periphery of the aerosol-generating device for moving the top cover between the first and second position. The periphery of the aerosol-generating device may be the outer surface of the top cover or the outer contour of the top cover. The protruding element may be a button, clip, lever, bump or pin. Preferably, the protruding element abuts the top cover. The protruding element may extend from the outer surface of the top cover perpendicularly away from the longitudinal axis of the aerosol-generating device. The position of the protruding element may be fixed with respect to the top cover. The protruding element may possess slip-resistant properties. The surface of the protruding element may be serrated. The protruding element may be made of a plastic or a rubber.

The main body may comprise a slot. Preferably, the slot is provided on the outer surface of the main body. The outer surface of the main body may be the outer contour of the main body. The slot may be a depression or groove in the main body. The slot may extend parallel to the longitudinal axis of the aerosol-generating device. The protruding element may engage with the slot. The protruding element may be arranged within the slot. Preferably, the protruding element engages with the slot such that the protruding element is movable within the slot in a direction parallel to the longitudinal axis of the aerosol-generating device.

The consumer may engage with the protruding element, preferably by pushing the protruding element in a direction parallel to the longitudinal axis of the aerosol-generating device, to move the top cover from the first position to the second position. The consumer may engage with the protruding element, preferably by pushing the protruding element in a direction parallel to the longitudinal axis of the aerosol-generating device to move the top cover from the second position to the first position. The protruding element may protrude from the aerosol-generating device. The user may move the protruding element by engaging the protruding element with a user's digit. Provision of the protruding element enhances the comfort for the user to change the position of the top cover. The slot may guide the movement of the top cover when the top cover is moved by means of the protruding element. The slot may enhance the comfort of operating the protruding element. The aerosol-generating device may comprise any known locking means for holding the top cover in the second position. If a user wants to operate the aerosol-generating device, the user may operate the locking means such that the top cover may no longer be held in the second position. A user may operate the locking means in any known way, for example by pushing a button or by pushing down the top cover or by pushing the protruding element. The at least one first biasing element may then automatically move the top cover into the first position, in which an aerosol-generating article may be inserted into the cavity and the aerosol-generating device may be operated. After operation in the first position, the user may push the top cover back to the second position against the retaining action of the biasing elements, for example by pushing the protruding element, and the spent aerosol-generating article may automatically be ejected from the cavity by means of the ejector. Additionally, the user may activate the locking means, when the top cover reaches the second position such that the aerosol-generating device is held in the second position again. The locking means may be automatically activated, when the top cover is moved from the first position to the second position. For example, the locking means may comprise a snap or lock-in connection. The locking means may be engaged or disengaged by a user pushing on the top cover or pushing the protruding element. Preferably, the top cover is initially held in the second position. Upon a first push of the user, the locking means may be disengaged so that the top cover is, by means of the at least one biasing element, moved towards the first position. After operation of the aerosol-generating device, the user, by means of a second push, may move the top cover to the second position again, in which the locking means may be engaged to securely hold the top cover in the second position.

The aerosol-generating device may further comprise at least one second biasing element, preferably a second spring, for biasing the ejector towards the cavity during movement of the top cover from the first position to the second position.

The at least one second biasing element may ensure that the ejector is pushed into the cavity during movement of the top cover from the first position to the second position. During movement from the second position to the first position, the at least one second biasing element may push the ejector away from the main body. The ejector, on the other hand, may push the top cover away from the main body and towards the first position. Hence, the at least one second biasing element may bias the top cover towards the first position.

One or more of the top cover and the main body may comprise a guiding element for guiding the movement of the top cover relative to the main body.

The guiding element may be provided as a slit or cavity or groove in one or more of the main body and the top cover. Preferably, if the guiding element is arranged in the main body, the top cover comprises a corresponding element engaging with the guiding element and vice versa. The guiding element facilitates secure movement of the top cover from the first position to the second position and vice versa.

The cavity may comprise a heater, wherein the ejector may comprise an opening, and wherein the opening may be arranged such that the heater passes through the opening during movement of the top cover from the first position to the second position. The opening may be arranged at the proximal end of the ejector.

The ejector may have a hollow shape. The top cover may comprise the heater. The top cover may be configured to slide inside of the ejector. A heater mounting section of the top cover may be configured to slide inside of the ejector. The heater may be mounted on the top cover, which is configured to be slidable inside the ejector. In the first position, the heater may be extended through the opening at the proximal end of the ejector. In the second position, the heater may be partially or fully retracted through the opening.

The ejector may comprise a first cleaning element at least partially surrounding the opening for cleaning the heater when the heater passes through the opening.

The first cleaning element may comprise an elastic element. The first cleaning element may comprise a resilient element. The first cleaning element may be configured as a wiper, preferably as two opposing wipers. The first cleaning element may fully surround the opening at the proximal end of the ejector. Between the heater and the opening of the ejector, a gap may be provided. The gap may have a width of between approximately 0.25 mm and approximately 3 mm, more preferably between approximately 0.5 mm and approximately 1.5 mm. The first cleaning element may close the opening, if the heater does not extend through the opening. Closing the opening may prevent contamination from entering the opening. The first cleaning element may seal, preferably hermetically seal, the opening. The first cleaning element may facilitate waterproofing of the opening. The first cleaning element may lie against the heater, when the heater extends through the opening. The first cleaning element may scrape unwanted residues off of the heater, when the heater is moved through the opening. The first cleaning element may be configured as a membrane. The first cleaning elements may comprise, preferably is made of, one or more of: metallic alloy, preferably stainless steel alloy medical grade, graphene compound, graphene compound with ceramide micro-particles. The first cleaning element may have a thickness of between approximately 0.07 mm and approximately 0.7 mm, preferably between approximately 0.25 mm and approximately 0.55 mm. The first cleaning element may extend or may be bent, at least when lying against the heater, towards a downstream direction. The first cleaning element may have a generally lateral shape and upward bend ends contacting the heater. The angle of attack between the heater and the first cleaning element may be between approximately 2° and approximately 9°, preferably between approximately 3° and approximately 7°. The angle of attack may be measured from the longitudinal axis of the heater. The ends of the first cleaning element may be bent, in comparison to the lateral portion of the first cleaning element, by between approximately 1.5 mm and approximately 7 mm, preferably by between approximately 2 mm and approximately 5 mm.

The ejector may be configured to penetrate into the cavity during movement of the top cover from the first position to the second position. The ejector may be pushed into the cavity during movement of the top cover from the first position to the second position. The second biasing element may push the ejector.

The ejector may comprise a second cleaning element arranged at, preferably surrounding, the proximal end of the ejector facing the cavity. The second cleaning element may be arranged for cleaning the inner wall of the cavity during movement of the top cover from the first position to the second position.

The second cleaning element may comprise, preferably is made of, one or more of: a metallic alloy, preferably stainless steel alloy medical grade, graphene compound, graphene compound with ceramide micro-particles. The second cleaning element may have a thickness of between approximately 0.1 mm and approximately 0.8 mm, preferably between approximately 0.3 mm and approximately 0.5 mm. The second cleaning element may comprise the same material as the first cleaning element. The second cleaning element may comprise an elastic element. The second cleaning element may comprise a resilient element. The second cleaning element may fully surround the outer perimeter of the proximal end of the ejector. The second cleaning element may be configured as a ring or may have a ring shape. Between the outer perimeter of the ejector and the sidewall of the cavity, a gap may be provided. The gap may have a width of between approximately 0.25 mm and approximately 4 mm, more preferably between approximately 0.75 mm to approximately 2 mm. The second cleaning element may extend slightly beyond the outer perimeter of the ejector to bridge the gap. The second cleaning element, together with the proximal end of the ejector, may close the distal end of the cavity. Closing the distal end of the cavity may prevent contamination from entering through the distal end of the cavity. The second cleaning element may seal, preferably hermetically seal, the gap. The second cleaning element may facilitate waterproofing of the gap, i.e. of the outer perimeter of the ejector at the distal end of the cavity. The first and second cleaning elements together may facilitate waterproofness of the aerosol-generating device. The second cleaning element may lie against the side wall of the cavity. The second cleaning element may scrape unwanted residues off of the sidewall of the cavity, when the top cover is moved from the first position to the second position. The second cleaning element may be configured as a membrane. The second cleaning element may extend or may be bent towards a downstream direction. The second cleaning element may have a generally lateral shape and upward bend ends contacting the sidewall of the cavity. The angle of attack between the side wall of the cavity and the second cleaning element may be between approximately 2° and approximately 15°, preferably between approximately 4° and approximately 11°. The angle of attack may be measured from the longitudinal extension of the sidewall of the cavity. The ends of the second cleaning element may be bent, in comparison to the lateral portion of the second cleaning element, by between approximately 0.75 mm and approximately 5 mm, preferably by between approximately 1 mm to approximately 3 mm.

One or more of the top cover and the side wall of the cavity may comprise, preferably be made of, plastic or from a metal such as a stainless steel alloy.

One or more of the top cover and the main body may comprise a detector, preferably an electrical switch, configured to detect whether the top cover is in the first position or in the second position.

The detector may be arranged between the top cover and the main body. The detector may be configured to detect when the top cover is retracted towards the main body. The detector may be arranged at the main body adjacent, preferably in direct abutment, to the cavity of the top cover, when the top cover is in the second position. The top cover may comprise a portion of the detector and the main body may comprise a portion of the detector. When the portion of the detector of the top cover comes near the portion of the detector of the main body, the detector may detect that the top cover is in the second position. Alternatively or additionally, portions of the detector may be arranged at positions of one or more of the main body and the top cover corresponding to the first position and the second position of the top cover. Portions of the detector may be configured to detect when the top cover is in the first position.

Depending upon the output of the detector, the aerosol-generating device may be automatically activated or deactivated. The aerosol-generating device may be automatically activated when the detector detects that the top cover is in the first position. In this case, an aerosol-generating article may be inserted into the cavity for generating an inhalable aerosol. When the top cover is moved from the first position to the second position, the detector may detect that the top cover is in the second position and deactivate the aerosol-generating device. The term 'activated' may refer to operating the heater. The term 'deactivated' may refer to not operating the heater. An unwanted activation may be prevented by the present invention. The activation or deactivation may be facilitated button-less only by the movement of the top cover.

One or more of the first cleaning element and the second cleaning element may be configured as a sealing element for closing, preferably sealing, more preferably hermetically sealing, the cavity when the top cover is in the second position.

In the second position, the cavity may essentially be, preferably fully, occupied by at least the ejector. In this case, the proximal end of the ejector may be arranged at the proximal end of the cavity. The proximal end of the ejector may be closed by one or more of the first cleaning element and the second cleaning element. In more detail, the potential opening in the proximal end of the ejector may be closed by the first cleaning element. The second cleaning element may close the gap between the outer perimeter of the ejector and the inner wall of the cavity. Hence, the cleaning elements may have a double functionality. The first functionality of the cleaning elements may be to clean one or more of the heater and the inner wall of the cavity. The second functionality of the cleaning elements may be to close the proximal end of the cavity by closing the proximal end of the ejector.

The ejector may comprise, preferably is made of, a polymeric component or a metal such as a stainless steel alloy.

At the proximal end of the ejector, the ejector may comprise one or more openings. The openings may be configured as air inlets to enable airflow through the ejector into the cavity. One or more of the top cover and the main body may comprise one or more air inlets to enable airflow through the device and towards the cavity, in which an aerosol-generating article is to be placed.

The top cover may comprise an indicator configured to indicate when an aerosol-generating article may be fully inserted into the cavity.

The indicator may indicate full insertion of the aerosol-generating article by one or more of: haptic means such as by vibration, visual means such as by an LED and audio means such as by a sound, for example a mechanical "click", whereby no electronics are needed. The indicator may comprise a micro-mechanical switch or optical or proximity sensors. At the proximal end of the ejector, a mechanical clicker lid may be arranged, which may be actuated if the ejector or the heater gets pressurized and the pressure exceeds a predetermined threshold.

The aerosol-generating device may also comprise a latching means. The latching means may releasably lock two components of the aerosol generating device together. The latching means may comprise "female" and "male" connectors. The male connector may comprise a protuberance, projection or protrusion. The female connector may comprise a notch, recess or receptacle. The male connector may engage with the female connector, for example the protuberance may be received by the recess. The male connector may be part of one component of the aerosol-generating device, while the female connector may be part of another component of the aerosol-generating device. Such two components may be releasably locked to each other by the engagement between the male connector and female connector. The top cover may comprise a female connector and the ejector may comprise a male connector or vice versa. The latching means may releasably lock the ejector to the top cover. The latching means may releasably lock the ejector to the main body. The top cover may comprise a notch or recess. The notch or recess of the top cover may be disposed on the surface of the top cover facing the ejector. The notch or recess may have a triangular cross section. The ejector may comprise a protuberance. The protuberance may be a projection or a protrusion. The protuberance may be a lever. The protuberance may be disposed on the surface of the ejector facing the top cover. The protuberance may be made from an elastic material. The protuberance may be movable with respect to the ejector. The latching means may comprise the notch or recess of the top cover and the protuberance of the ejector. The notch or recess of the top cover may be structurally complementary to the protuberance of the ejector. The protuberance of the ejector may engage with the notch or recess of the top cover. By engaging with the notch or recess, the protuberance may temporarily lock the ejector to the top cover. The aerosol-generating device may comprise a releasing means. The latching means may comprise the notch or recess of the top cover, the protuberance of the ejector and the releasing means. The releasing means may disengage the male connector from the female connector and vice versa. The releasing means may disengage the protuberance from the notch or recess. The releasing means may be a cylinder, pin, rod, bar, pole or any other means with which a pressure can be exerted on the protuberance. The releasing means may be solid. The releasing means may be a solid cylinder. The releasing means may comprise a protective element. The protective element may be accessible to the user. The protective element may be dome-shaped. The protective element may be made from a soft material. The protective element may be made from an elastic material. The protective element may be made from plastic or rubber. The user may engage with the protective element. The protective element may increase the comfort of the user. The main body or the top cover may comprise an aperture. The main body and the top cover may comprise an aperture. The releasing means may be movably inserted into the aperture. The aperture may be disposed adjacent to the notch or recess of the top cover. The aperture may be disposed such that the releasing means engages with the protuberance. Preferably, the releasing means may be used to exert a pressure on the protuberance such that the protuberance is pushed away from the notch or recess of the top cover. After disengaging the notch or recess from the protuberance, the ejector may be movable relative to the top cover. The ejector may be movable relative to the top cover by means of the second biasing element.

In use, the user may move the ejector relative to the top cover and the main body. When the cavity is closed, the user may push the ejector, for example by inserting an aerosol-generating article, towards the second biasing element to open the cavity. When the relative position of the notch or recess of the ejector and the protuberance match, the notch or recess of the ejector and the protuberance engage with each other to temporarily couple the ejector to the top cover. In this configuration, the aerosol-generating device may generate an aerosol by heating the aerosol-generating article, such that the consumer may inhale the generated aerosol. When the consumer is finished, the aerosol-generating article may be removed by using the releasing means. By engaging with the releasing means, the user may push the protuberance towards the ejector and away from the notch or recess, such that the protuberance is disengaged from the notch or recess. Once the coupling between the notch or recess and the protuberance is disengaged, the second biasing element may push the ejector towards the proximal end of the cavity, such that the cavity is closed.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder. The device may be an electrically heated smoking device.

As used herein, the term 'aerosol-generating article' refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. A smoking article comprising an aerosol-forming substrate comprising tobacco is referred to as a tobacco stick.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The aerosol-generating article may have a total length between approximately 30 mm and approximately 100 mm. The aerosol-generating article may have an external diameter between approximately 5 mm and approximately 12 mm. The aerosol-generating article may comprise a filter plug. The filter plug may be located at a downstream end of the aerosol-generating article. The filter plug may be a cellulose acetate filter plug. The filter plug is approximately 7 mm in length in one embodiment, but may have a length of between approximately 5 mm to approximately 10 mm.

In one embodiment, the aerosol-generating article has a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The aerosol-generating article may comprise an outer paper wrapper. Further, the aerosol-generating article may comprise a separation between the aerosol-forming substrate and the filter plug. The separation may be approximately 18 mm, but may be in the range of approximately 5 mm to approximately 25 mm.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than about 5% on a dry weight basis. Homogenised tobacco material may alternatively have an aerosol former content of between about 5% and about 30% by weight on a dry weight basis. Sheets of homogenised tobacco material may be formed by agglomerating particulate tobacco obtained by grinding or otherwise combining one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In a particularly preferred embodiment, the aerosol-forming substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-generating device may comprise the electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heater. Power may be supplied to the heater continuously following activation of the aerosol-generating device or may be supplied intermittently, such as on a puff-by-puff basis. The power may be supplied to the heater in the form of pulses of electrical current. The electric circuitry may be configured to monitor the electrical resistance of the heater, and preferably to control the supply of power to the heater dependent on the electrical resistance of the heater. The electric circuitry may be arranged in the main body.

The aerosol-generating device may comprise a power supply, typically a battery, within the main body. As an alternative, the power supply may be another form of charge storage device such as a capacitor. The power supply may require recharging and may have a capacity that enables to store enough energy for one or more smoking experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heater.

The invention also relates to an aerosol-generating system comprising an aerosol-generating device as described above and an aerosol-generating article comprising aerosol-forming substrate.

There is also provided a method for ejecting an aerosol-generating article from an aerosol-generating device, comprising:

providing an aerosol-generating device comprising a main body; a top cover, wherein the top cover comprises a cavity configured for insertion of an aerosol-generating article comprising aerosol-forming substrate into the cavity; and an ejector, wherein the top cover is movable between a first position and a second position with respect to the main body, wherein, in the first position, the top cover is extended from the main body and the cavity is accessible for insertion of an aerosol-generating article, wherein, in the second position, the top cover is retracted towards the main body and the cavity is closed, and wherein the ejector is configured to eject an aerosol-generating article from the cavity during movement of the top cover from the first position to the second position, arranging the top cover in the first position, inserting, into the cavity of the top cover, an aerosol-generating article, moving the top cover from the first position to the second position thereby ejecting the aerosol-generating article from the cavity of the top cover by means of the ejector.

The method may comprise the step of operating the aerosol-generating device. Operating the aerosol-generating device may comprise the step of activating the heater. The method may comprise the step of activating the aerosol-generating device. The activating the aerosol-generating device may comprise the step of activating the heater. The method may comprise the step of penetrating the aerosol-forming substrate of the aerosol-generating article by the heater.

DESCRIPTION OF THE DRAWINGS

The invention will be further described, by way of example only, with reference to the accompanying drawings in which:

FIG. 1 shows a cross-sectional view of a part of an aerosol-generating device according to an embodiment of the present invention. The illustrated aerosol-generating device comprises a main body 10, a top cover 12 and an ejector 14.

Figure 1:
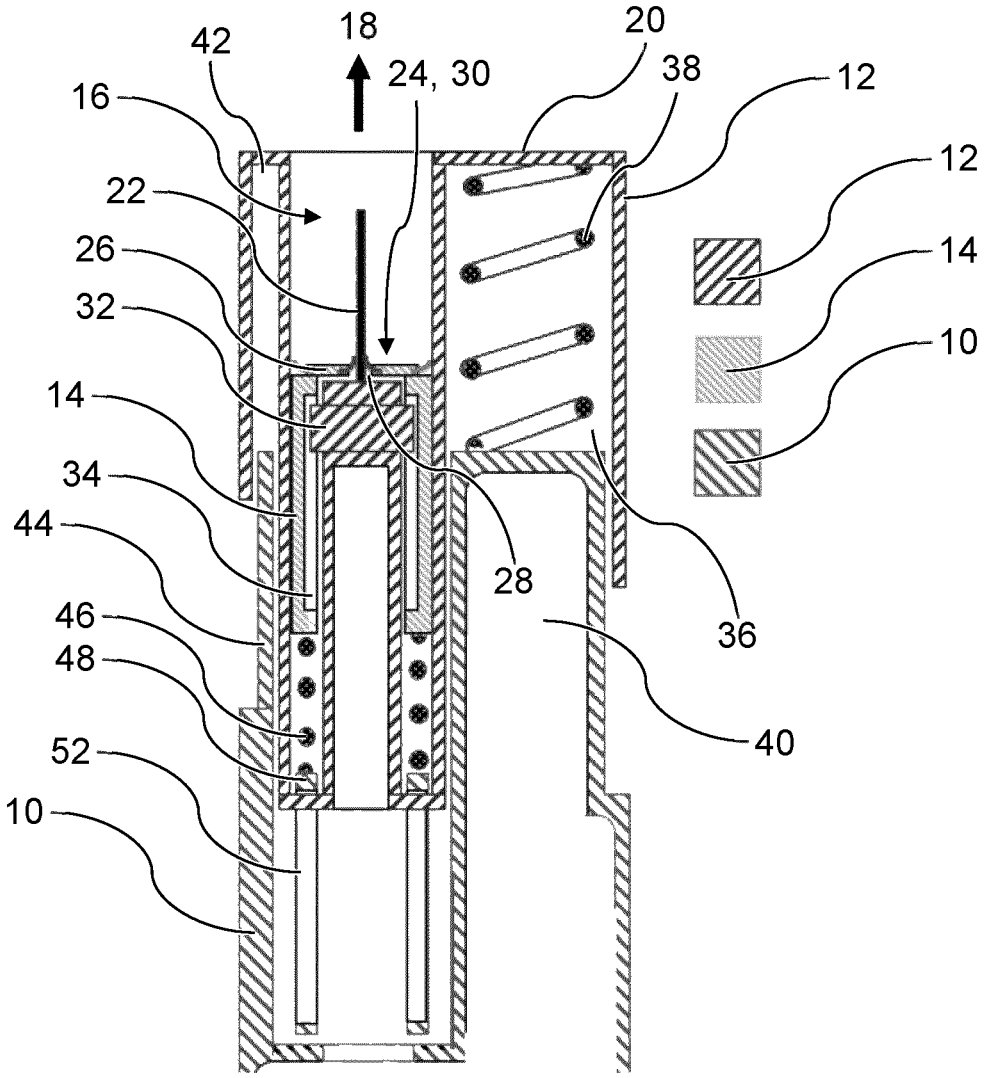
FIG. 1 shows a cross-sectional view of parts of the aerosol-generating device according to an embodiment of the present invention.

The top cover 12 shown in FIG. 1 comprises a cavity 16 constituting a heating chamber. The cavity 16 extends parallel to the longitudinal axis of the aerosol-generating device. The cavity 16 is open towards a downstream direction 18. In other words, the cavity 16 is open at the proximal end 20 of the top cover 12. A heater 22 is arranged in the cavity 16. The heater 22 is arranged centrally in the cavity 16. The heater 22 is configured as a heating blade. However, it is understood that in other embodiments the heater could be shaped as a heating pin. The heater 22 may comprise a resistive heating element (not shown).

At the base of the cavity 16, which is the upstream end 24 or distal end 30 of the cavity 16, the proximal or downstream end 26 of the ejector 14 is arranged. The ejector 14 has a planar proximal end 26 with an opening 28. The opening 28 is provided so that the heater 22 can extend through the opening 28. The heater 22 is mounted on the top cover 12. The part of the top cover 12 onto which the heater 22 is mounted reaches into the ejector 14. For this reason, the ejector 14 is hollow and open at the distal end. The ejector 14 has a hollow shape.

The part of the top cover 12 which is arranged inside of the ejector 14 may comprise a collar 32 reaching into a corresponding groove or recess 34 of the ejector 14 so that the movement of the ejector 14 relative to the top cover 12 or vice versa is limited by the movement of the collar of the top cover 12 within the groove or recess 34 of the ejector 14.

The top cover 12 may comprise a first guiding cavity 36, which extends parallel to the longitudinal axis of the aerosol-generating device. A first biasing element 38, preferably a first spring 38, is arranged within the first guiding cavity 36. The first guiding cavity 36 may have a tubular shape. The first guiding cavity 36 may be closed at the downstream or proximal end. The first guiding cavity 36 may be open at the upstream or distal end. The first guiding cavity 36 may be shaped to fit over a corresponding first projection 40 of the main body 10. The first guiding cavity 36 and the first projection 40 of the main body 10 may be dimensioned such that the first projection 40 may slide within the first guiding cavity 36. This arrangement may facilitate secure and guided movement of the top cover 12 with respect to the main body 10. The first biasing element 38 may be arranged between the first guiding cavity 36 and the first projection 40 within the first guiding cavity 36. The first biasing element 38 may be mounted on the proximal end of the first projection 40. The first biasing element 38 may be configured to bias the top cover 12 towards the first position, in which the top cover 12 is extended away from the main body 10.

The top cover 12 may comprise a second guiding cavity 42. The second guiding cavity 42 may extend parallel to the longitudinal axis of the aerosol-generating device. The second guiding cavity 42 may have a tubular shape. A corresponding second projection 44 may be arranged at the main body 10. The second projection 44 may project into the second guiding cavity 42 for facilitating secure movement of the top cover 12 with respect to the main body 10. If desired, more than two guiding cavities and more than two projections may be provided. Also, if desired, the main body 10 may comprise the cavities and the top cover 12 may comprise the projections. The top cover 12 may comprise further guiding cavities, for example for guiding the movement of the ejector 14 as depicted in FIG. 1.

Between the ejector 14 and the main body 10, a second biasing element 46, preferably a second spring, may be arranged. The second biasing element 46 may be mounted at a stop 48 of the main body 10, which may reach into the top cover 12. The stop 48 may limit the movement of the top cover 12 with respect to the main body 10. The stop 48 may prevent the top cover 12 from fully disengaged from the main body 10. The stop 48 may prevent the top cover 12 from extending away from the main body 10 further than the first position. The second biasing element 46 may bias the ejector 14 away from the main body 10.

During operation, the aerosol-generating device may initially be in the second position as will be described in more detail below with respect to FIG. 11. In the second position, the top cover 12 is retracted towards the main body 10. A user may deactivate the locking means, preferably by pressing the locking means or by pushing on the top cover 12. By deactivating the locking means, a locking action between the top cover 12 and the main body 10 may be deactivated and the first biasing element 38 may push the top cover 12 away from the main body 10 towards the first position. Then, the cavity 16 of the top cover 12 is generated by the top cover 12 moving away from the main body 10 and moving away from the ejector 14. Additionally, the heater 22 mounted on the top cover 12 passes through the opening 28 at the proximal end 26 of the ejector 14 so that the heater 22 is arranged in the cavity 16. When the top cover has reached the first position, an aerosol-generating article 50 may be inserted by a user into the cavity 16 so that the heater 22 penetrates into the aerosol-forming substrate contained in the aerosol-generating article 50. The heater 22 may subsequently be activated for producing an inhalable aerosol. After the aerosol-forming substrate in the aerosol-generating article 50 is spent, a user may want to deactivate the device and eject the aerosol-generating article 50. To facilitate this, a user may push down the top cover 12 towards the main body 10. By pushing the top cover 12 towards the main body 10, the ejector 14, more precisely the planar proximal end 26 of the ejector 14 pushes against the aerosol-generating article 50 and automatically ejects the aerosol-generating article 50 out of the cavity 16. At the same time, the heater 22 is retracted through the opening 28 and from the aerosol-forming substrate of the aerosol-generating article 50. The cavity 16 becomes smaller and at the end of the movement is essentially fully occupied by the ejector 14. The top cover 12 is then positioned in the second position again. The top cover 12 has a clean look in the second position. The cavity 16 of the top cover 12 is occupied by the ejector 14 in the second position so that contamination of the cavity 16 is prevented. Additionally, the cavity 16 is automatically cleaned as will be described below in more detail with respect to FIGS. 7 and 8.

Figure 2:
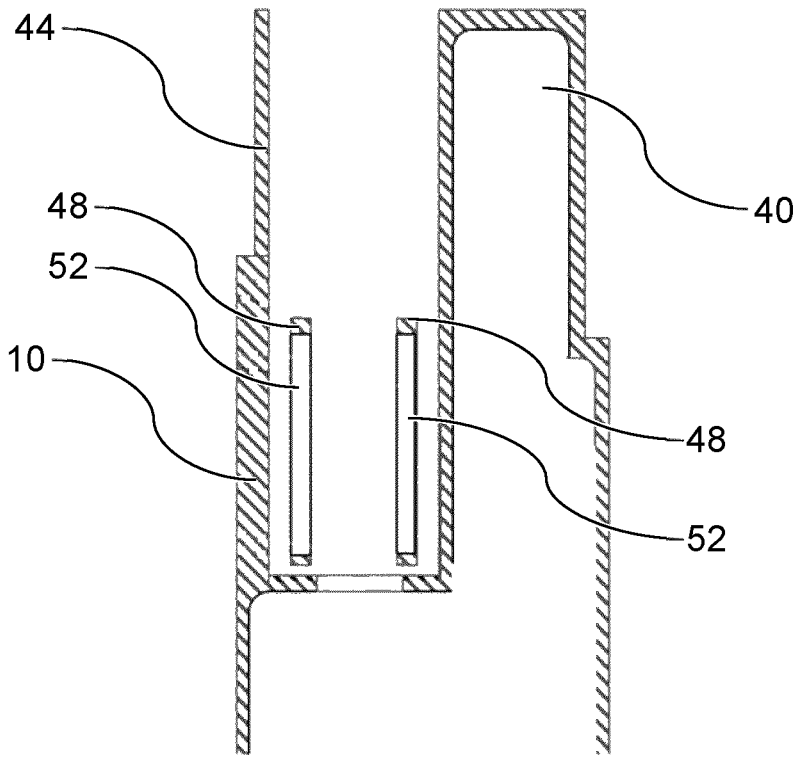
FIG. 2 shows a cross-sectional view of parts of a main body of the aerosol-generating device.

FIG. 2 shows the main body 10 isolated from the top cover 12 and from the ejector 14. In the embodiment shown in FIG. 2, the main body 10 comprises a first projection 40 and a second projection 44 which project into the top cover 12, when the top cover 12 is assembled together with the main body 10 and the ejector 14. In FIG. 2, the stop 48 of the main body 10 can clearly be seen. Between the stop 48 and a lower stop of the main body 10, guiding rails 52 may be arranged for facilitating the sliding movement between the top cover 12 and the main body 10.

Figure 3:
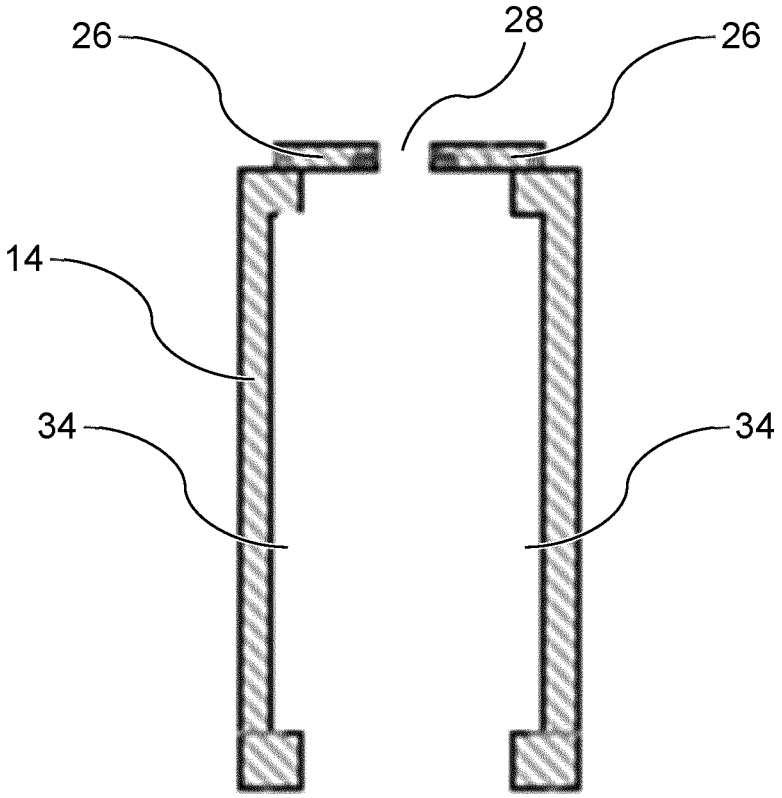
FIG. 3 shows a cross-sectional view of an ejector of the aerosol-generating device.

FIG. 3 shows, in isolation, the ejector 14. The ejector 14 has an essentially hollow shape. The ejector 14 comprises a planar proximal end 26 with an opening 28. The opening 28 is provided so that the heater 22 mounted on the top cover 12 can pass and extend through the opening 28. The ejector 14 comprises a side wall, which constitute an essentially tubular section of the ejector 14. Within the tubular section, a projection of the top cover 12 for mounting the heater 22 may be slidably arranged as shown in FIG. 1. The inner sidewalls of the tubular section may comprise a groove or recess 34, in which a collar 32 of the projection of the top cover 12 may be arranged to facilitate a sliding movement of the top cover 12 relative to the ejector 14.

Figure 4:
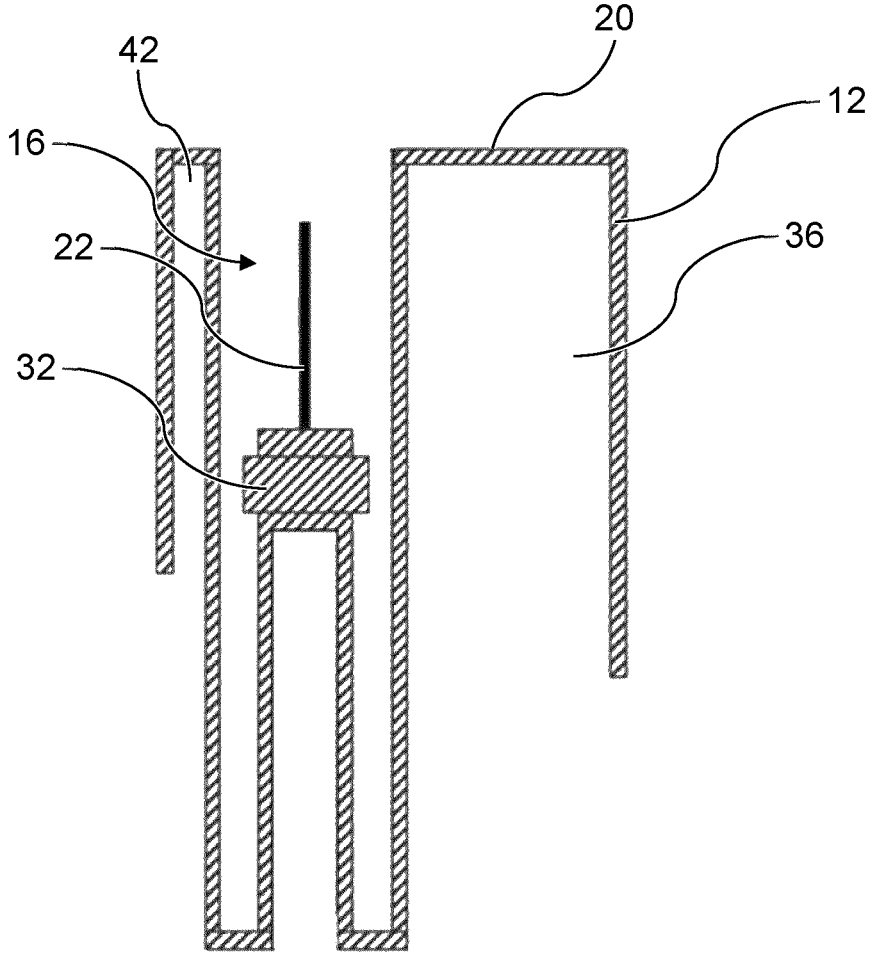
FIG. 4 shows a cross-sectional view of a top cover of the aerosol-generating device.

FIG. 4 shows the top cover 12 isolated from the main body 10 and from the ejector 14. The top cover 12 comprises the cavity 16 which is arranged as a heating chamber. The heater 22 is arranged in the cavity 16 and mounted on a projection of the top cover 12. The projection of the top cover 12, onto which the heater 22 is mounted, is arranged slidable in the ejector 14, if the ejector 14 is assembled with the top cover 12 and the main body 10. The top cover 12 as shown in FIG. 4 shows a first and a second guiding cavity 42, which are dimensioned corresponding to projections of the main body 10.

Figure 5:
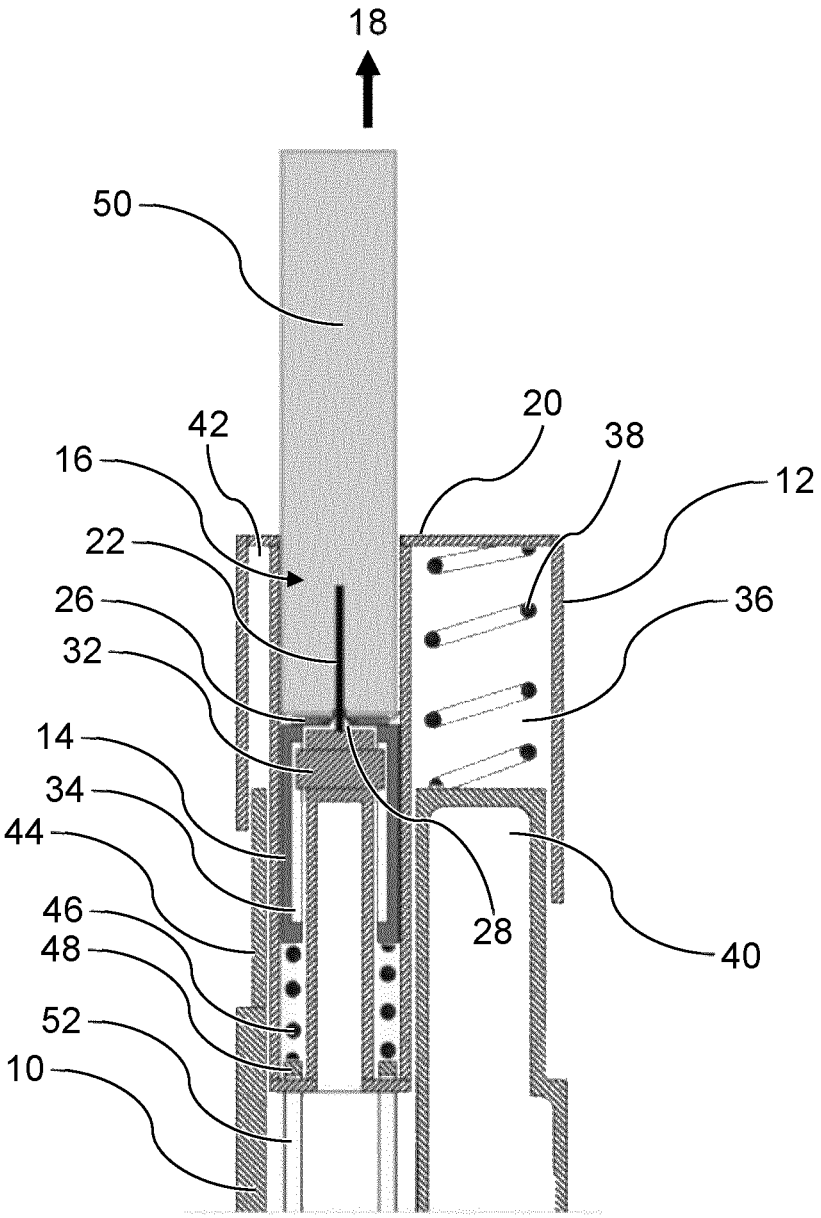
FIG. 5 shows a cross-sectional view of an aerosol-generating article inserted into the cavity of the top cover of the aerosol-generating device.

FIG. 5 shows the aerosol-generating device, wherein the top cover 12 is arranged in the first position. FIG. 5 additionally shows an aerosol-generating article 50 inserted into the cavity 16 of the top cover 12. Hence, FIG. 5 shows a configuration in which the aerosol-generating device can be operated and aerosol can be produced.

Figure 6:
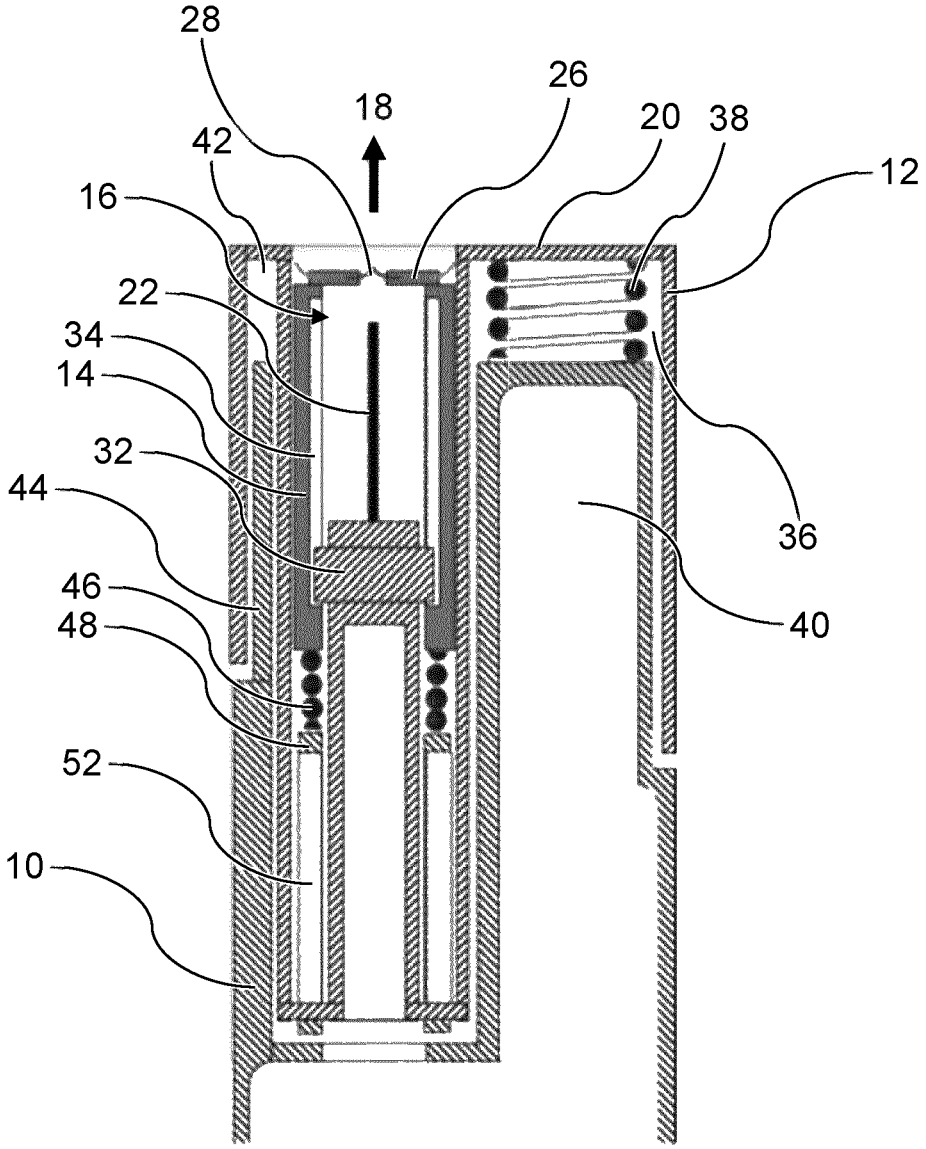
FIG. 6 shows a cross-sectional view of the top cover being in a second position.

FIG. 6 shows the aerosol-generating device, wherein the top cover 12 is arranged in the second position. Hence, the top cover 12 shown in FIG. 6 is retracted towards the main body 10 and held by the locking means. The locking means are not depicted in FIG. 6 but may be any conventional locking means known to the skilled person. The first biasing element 38 and the second biasing element 48 are compressed so that a biasing action acts on the top cover 12 urging the top cover 12 towards the first position and on the ejector 14 urging the ejector 14 away from the main body 10. The proximal end of the aerosol-generating device is formed by the proximal end 20 of the top cover 12 and the proximal end 26 of the ejector 14. In this regard, the proximal end 26 of the ejector 14 has penetrated into the cavity 16 and the ejector 14 occupies the cavity 16 in the second position of the top cover 12.

Figure 7:
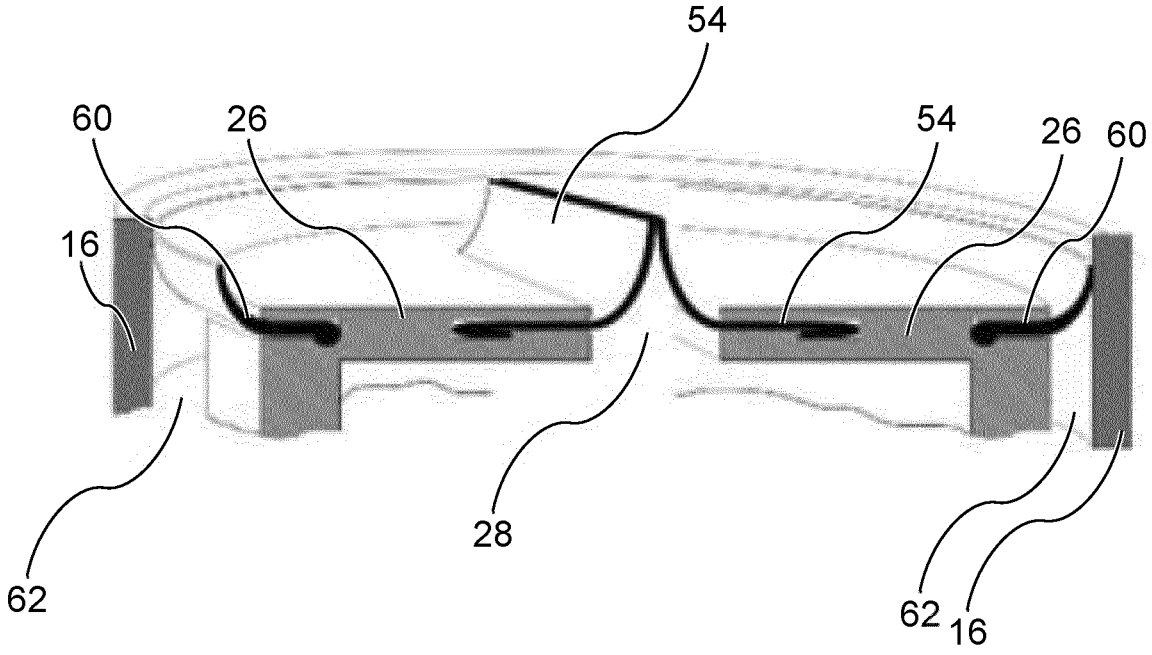
FIG. 7 shows a proximal end of the ejector with an opening and a first cleaning element and a second cleaning element.
Figure 8:
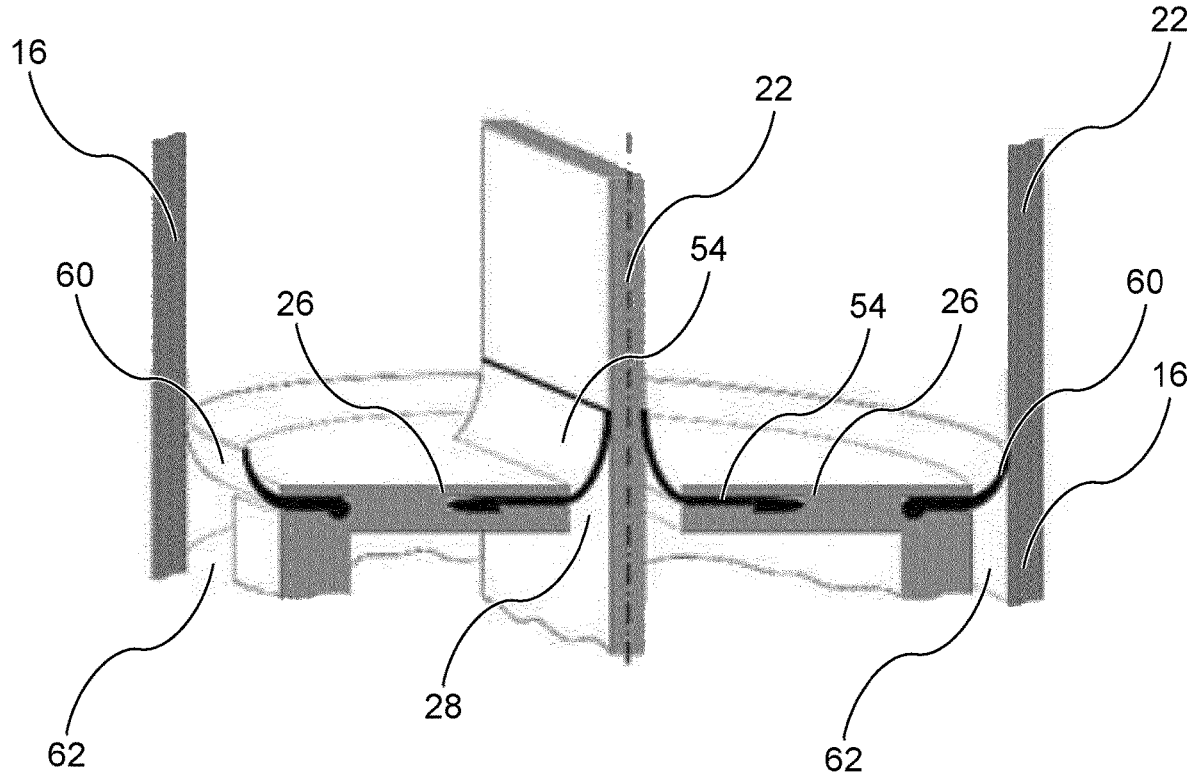
FIG. 8 shows the proximal end of the ejector with an opening and the first cleaning element and the second cleaning element, wherein a heater extends through the opening.

FIG. 7 shows a close view of the proximal end 26 of the ejector 14. As can be seen in FIG. 7, the ejector 14 comprises an opening 28, through which the heater 22 may pass. A first cleaning element 54 is arranged at the opening 28. The first cleaning element 54 is preferably a resilient element. The first cleaning element 54 may laterally extend into the material constituting the proximal end 26 of the ejector 14 so as to be securely held therein. The first cleaning element 54 may be bent up towards in a downstream direction 18 in order to close the opening 28, when the heater 22 does not extend through the opening 28. The first cleaning element 54 may have two functionalities. The first functionality may be a cleaning functionality. In more detail, if the heater 22 passes through the opening 28 of the proximal end 26 of the ejector 14 as depicted in FIG. 8, unwanted residues may be scraped off of the surface of the heater 22 by means of the first cleaning element 54. The second functionality of the first cleaning element 54 may be a sealing functionality. In this regard, as depicted in FIG. 7, if the heater 22 does not extend through the opening 28 at the proximal end 26 of the ejector 14, the first cleaning element 54, also referred to as the first sealing element 54, may close the opening 28 so as to prevent unwanted contamination to pass the opening 28. Unwanted contamination may otherwise get into the aerosol-generating device. The internal components of the aerosol-generating device are therefore protected.

The internal components of the aerosol-generating device may comprise electric circuitry 56 such as a controller and a power supply 58 such as a battery. The internal components of the aerosol-generating device may be overmolded and thus securely protected due to being physically separated from the heater 22. For electrically connecting the internal components of the aerosol-generating device with the heater 22, contacts may be provided between the main body 10 and the heater 22 mounted on the top cover 12. This arrangement may optimize maintenance, repair or replacement of the heater 22. Potentially, the whole top cover 12 may be replaced.

FIG. 7 additionally shows a second cleaning element 60 which is arranged around the outer perimeter of the proximal end 26 of the ejector 14. The second cleaning element 60 may, similar to the first cleaning element 54, extend laterally into the material constituting the proximal end 26 of the ejector 14 so as to be securely held therein. The second cleaning element 60 may be bent in a downstream direction 18 and rest against the inner side wall of the cavity 16 of the top cover 12. During movement of the top cover 12 from the first position to the second position and vice versa, the second cleaning element 60 may scrape off unwanted residues from the inner side wall of the cavity 16. Additionally, the second cleaning element 60 may act as a sealing element and prevent unwanted contamination to pass through the gap 62 between the inner sidewalls of the cavity 16 and the outer perimeter of the ejector 14.

FIG. 8 shows the proximal end 26 of the ejector 14, when the top cover 12 is in the first position. In other words, FIG. 8 shows that the top cover 12 is extended from the main body 10 and the cavity 16 is ready for an aerosol-generating article 50 to be inserted. The heater 22 consequently has passed through the opening 28 and thus extends through the opening 28 at the proximal end 26 of the ejector 14. In contrast, FIG. 7 shows the top cover 12 in the second position, in which the opening 28 at the proximal end 26 of the ejector 14 is closed by the first cleaning element 54.

Figure 9:
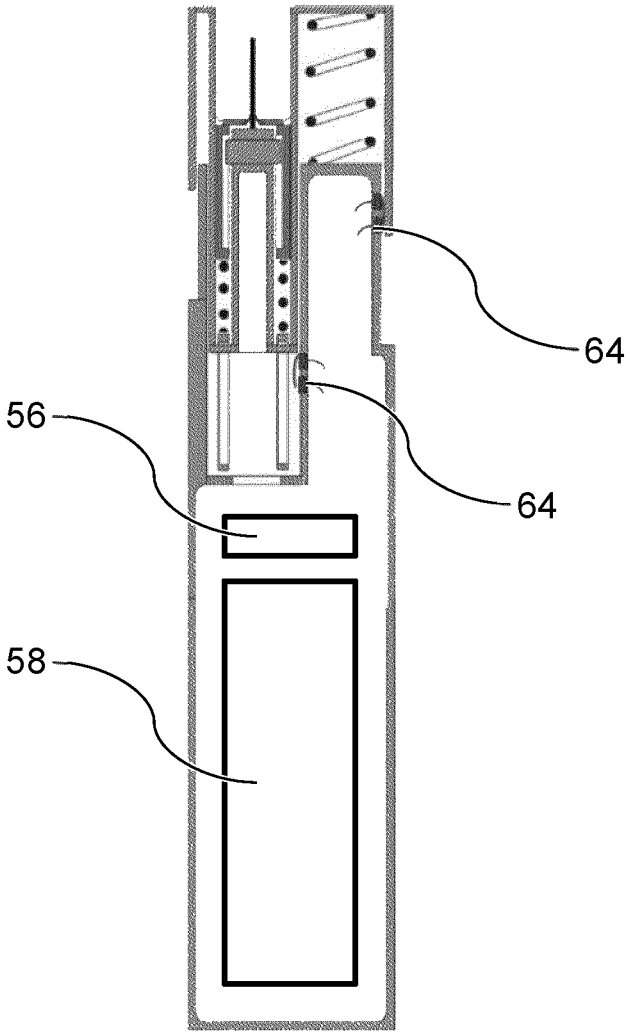
FIG. 9 shows a cross-sectional view of the aerosol-generating device and shows a detector for detecting the position of the top cover.

FIG. 9 shows the whole aerosol-generating device comprising further internal components such as the electric circuitry 56 and the power supply 58. Additionally, FIG. 9 shows a detector 64 for detecting whether the top cover 12 is in the first position or in the second position. The detector 64 preferably is configured as an electrical switch. The detector 64 may be connected with the electric circuitry 56. The electric circuitry 56 may allow operation of the heater 22, when the detector 64 detects that the top cover 12 is in the first position. The electric circuitry 56 may automatically operate the heater 22, when the detector 64 detects that the top cover 12 is in the first position. The electric circuitry 56 may prevent operation of the heater 22, when the detector 64 detects that the top cover 12 is in the second position.

Figure 10:
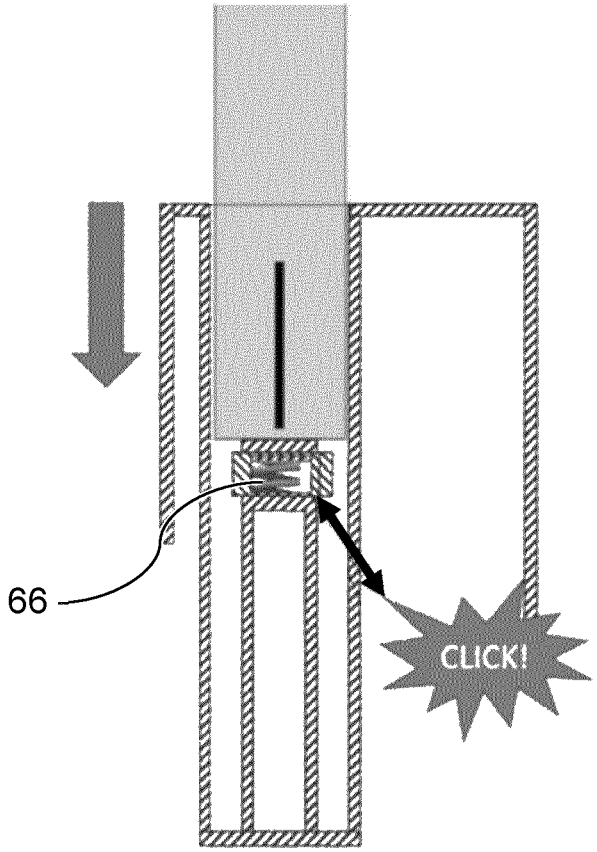
FIG. 10 shows an indicator for indicating full insertion of the aerosol-generating article.

FIG. 10 shows an embodiment, in which an indicator 66 is provided in the top cover 12 or in the ejector 14. The indicator 66 may be provided at the base of the cavity 16. The indicator 66 may be configured as a mechanical clicker lid which generates a sound similar to the click of a torque wrench to indicate to a user that an aerosol-generating article 50 has been fully inserted into the cavity 16. The indicator 66 may thus prevent damage to the aerosol-generating article 50 of the heater 22 due to a user applying an unnecessary force to the aerosol-generating article 50 during insertion, particularly after full insertion, of the aerosol-generating article 50 into the cavity 16.

Figure 11:
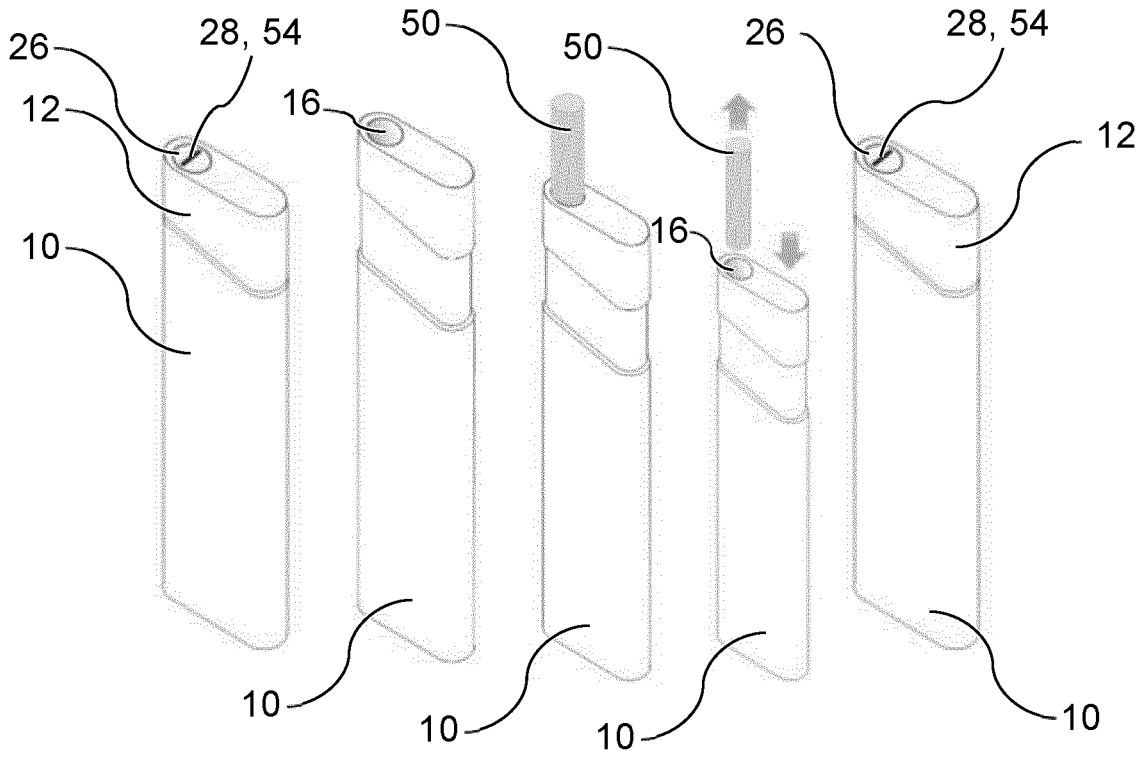
FIG. 11 shows the operation of the aerosol-generating device and the movement of the top cover between the first and the second position

FIG. 11 shows the different stages of the aerosol-generating device, particularly the different positions of the top cover 12 of the aerosol-generating device. From left to right, FIG. 11 shows the top cover 12 in the second position and the aerosol-generating device deactivated (first stage). Next, the top cover 12 is moved to the first position and the aerosol-generating device is ready to be activated or is activated (second stage). Next, an aerosol-generating article 50 is inserted into the cavity 16 of the top cover 12 and the device is operated (third stage). Next, the top cover 12 is moved from the first position to the second position, after the aerosol-generating article 50 is spent and the operation is ended (fourth stage). The right part of FIG. 11 (fifth stage) shows the aerosol-generating device again in the initial state, namely when the top cover 12 is in the second position and the aerosol-generating device is deactivated. FIG. 11 also shows that when the top cover 12 is in the second position, the cavity 16 is closed by the proximal end 26 of the ejector 14 and the first cleaning element 54 and the second cleaning element 60. Thus, intrusion of unwanted contamination into the cavity 16 or into the inner of the aerosol-generating device is prevented.

Figure 12:
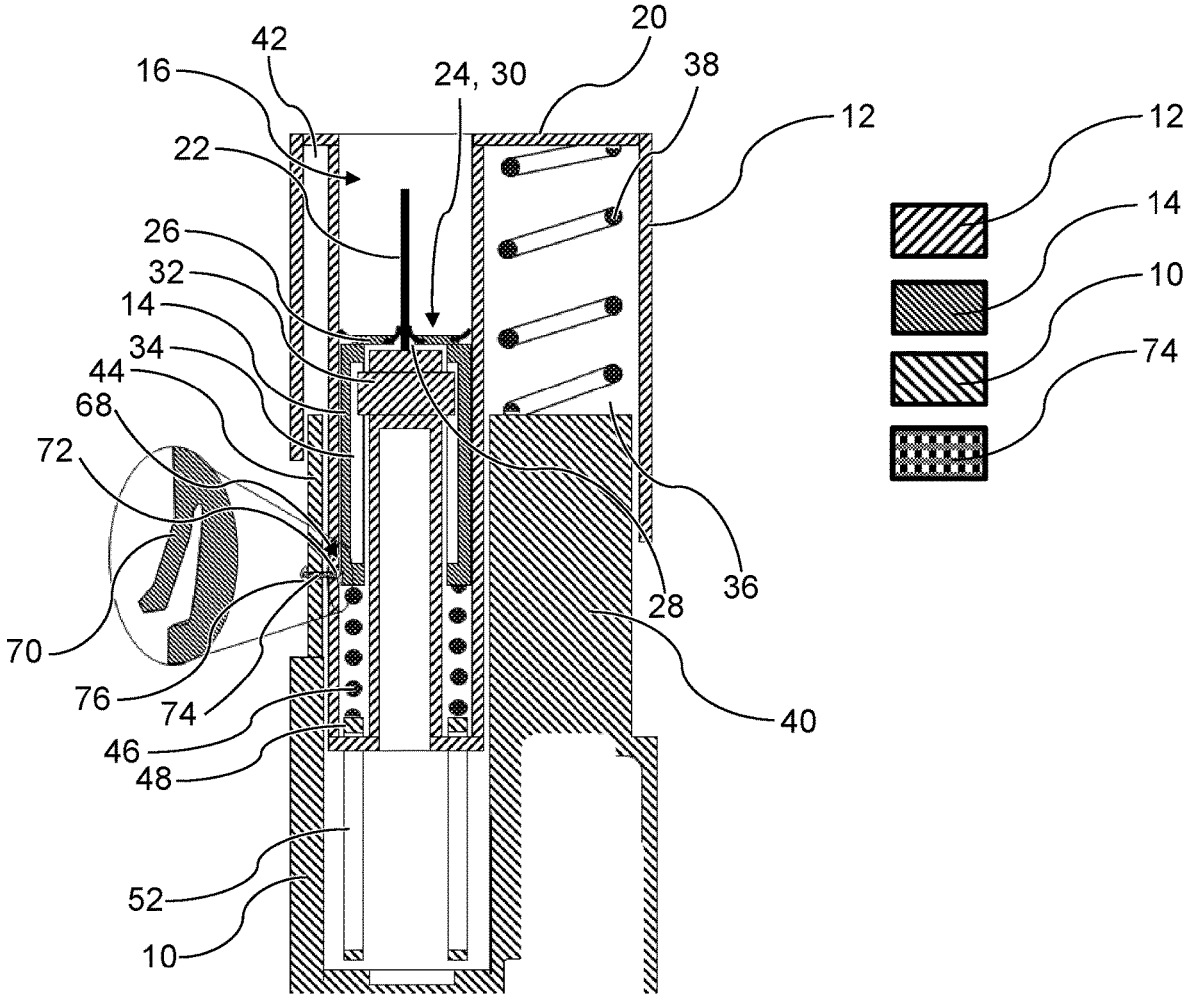
FIG. 12 shows a cross-sectional view of parts of the aerosol-generating device comprising a latching means in an engaged state
Figure 13:
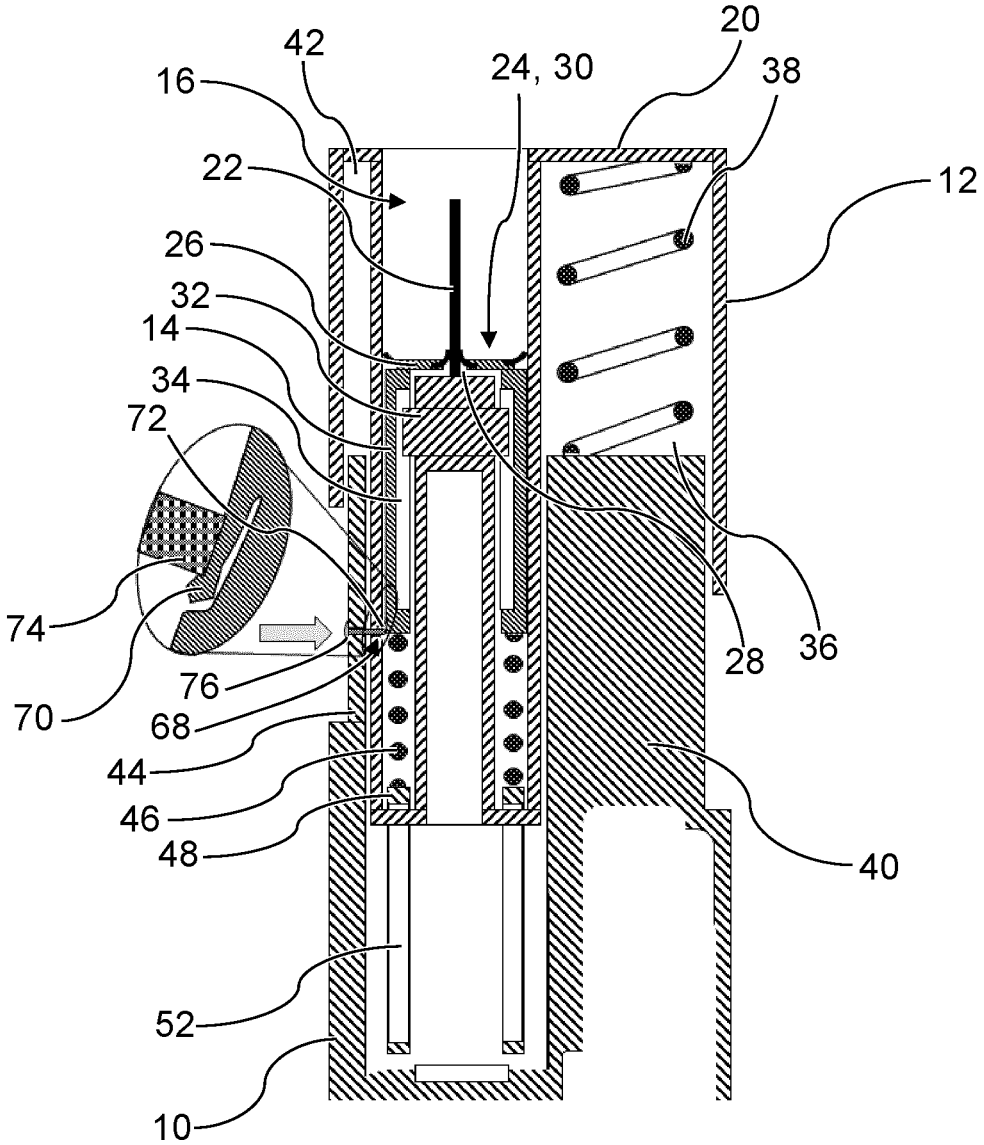
FIG. 13 shows a cross-sectional view of parts of the aerosol-generating device comprising a latching means in the process of being disengaged
Figure 14:
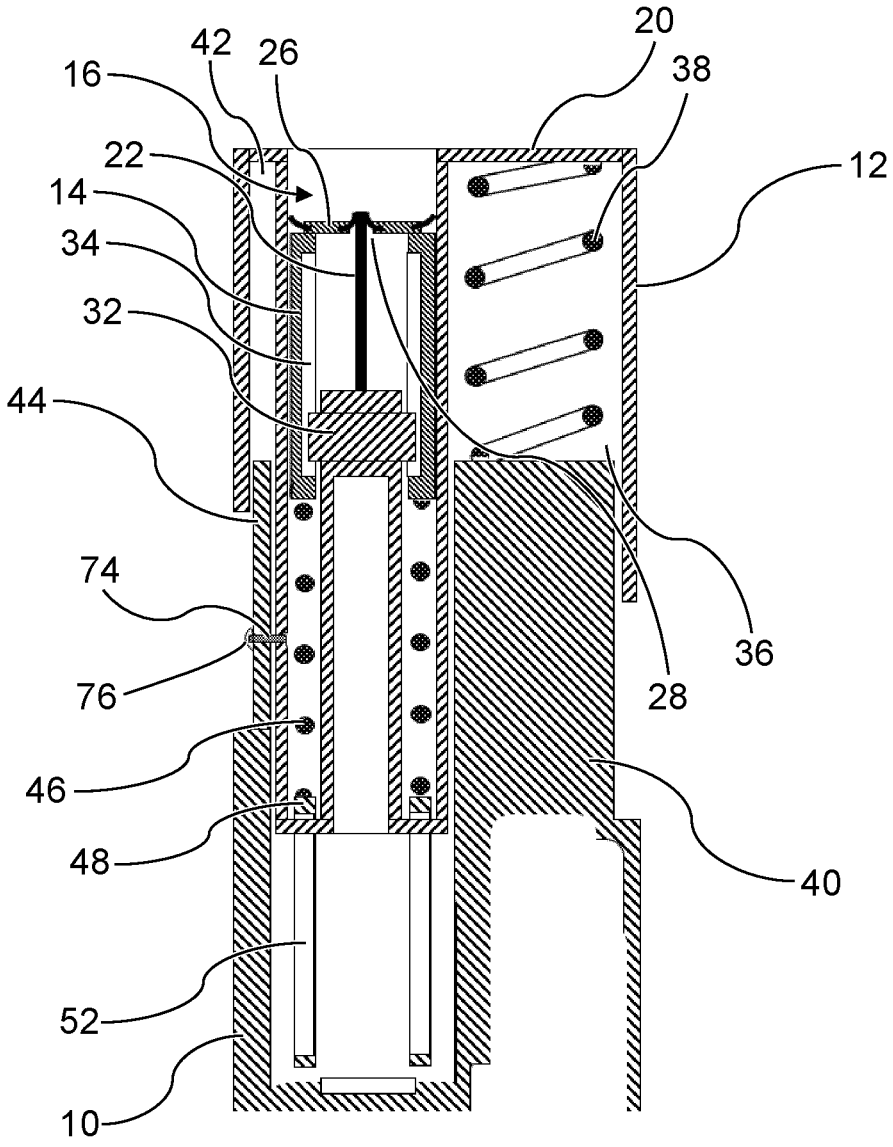
FIG. 14 shows a cross-sectional view of parts of the aerosol-generating device comprising a latching means in a disengaged state

FIG. 12 shows a cross-sectional view of parts of the aerosol-generating device comprising a latching means 68 in an engaged state. The latching means comprises a protuberance 70 of the ejector 14. In the shown embodiment, the protuberance 70 is a lever. The top cover 12 comprises a recess 72. The protuberance 70 is engaged with the recess 72. Such engagement releasably locks the ejector 14 to the top cover 12. In this configuration, the user may insert an aerosol-generating article into the cavity 16. The user may also use the aerosol-generating article to push the ejector 14 towards the biasing element 46 to engage the protuberance 70 with the recess 72 in the first place. The aerosol-generating device also comprises a releasing means 74. In the shown embodiment, the releasing means 74 is a solid cylinder. The releasing means 74 may be used by the user, preferably by pushing the releasing means 74 towards the protuberance 70, to exert a pressure on the protuberance 70. When the releasing means 74 exerts a pressure on the protuberance, the protuberance 70 is pushed away from the recess and is disengaged from the recess 72. FIG. 13 shows a cross-sectional view of parts of the aerosol-generating device comprising a latching means in the process of being disengaged. Such disengagement releases the ejector 14 from the top cover 12, such that the ejector is slidable within the cavity 16. Once the ejector 14 is released from the top cover 12 the biasing element 46 pushes the ejector towards the proximal end of the cavity 16. This is shown in FIG. 14. The releasing means 74 comprises a protective element 76. The protective element 76 is dome-shaped. The protective element 76 is made from an elastic material. The protective element is disposed such that the user readily engages with it when the user pushes on the releasing elements 74 in order to release the ejector 14 from the top cover 12.

Figure 15:
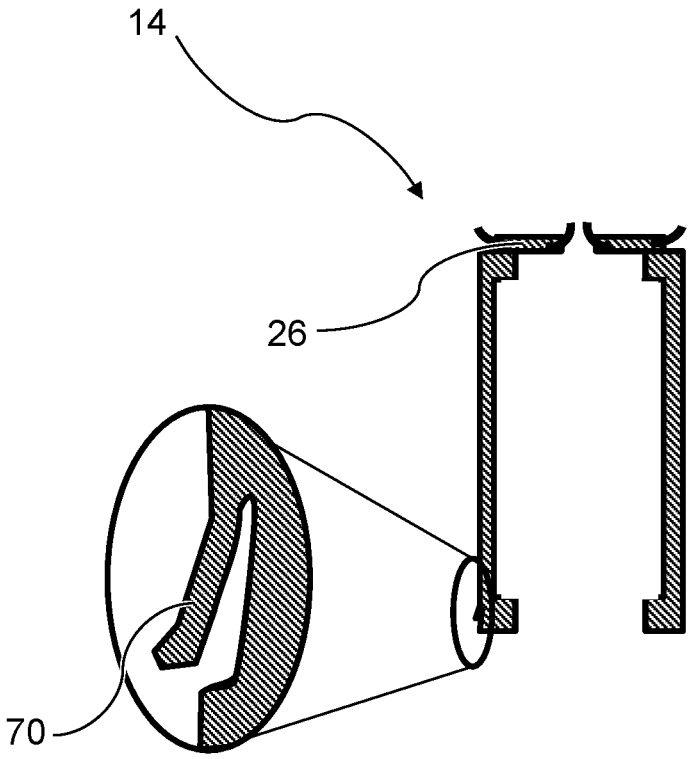
FIG. 15 shows a cross-sectional view of the ejector comprising a protuberance

FIG. 15 shows a cross-sectional view of the ejector comprising a protuberance 70. In the shown embodiment, the protuberance 70 is a lever.

Figure 16:
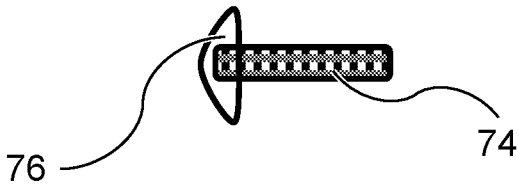
FIG. 16 shows a cross-sectional view of a releasing means.

FIG. 16 shows a cross-sectional view of a releasing means 74. In the shown embodiment the releasing means 74 is a solid cylinder. The shown releasing means 74 comprises a dome-shaped protective element 76.

The invention claimed is:

1. Aerosol-generating device comprising:

a main body;

a top cover, wherein the top cover comprises a cavity configured for insertion of an aerosol-generating article comprising aerosol-forming substrate into the cavity; and an ejector, wherein the top cover is movable between a first position and a second position with respect to the main body, wherein, in the first position, the top cover is extended from the main body and the cavity is accessible for insertion of the aerosol-generating article, wherein, in the second position, the top cover is retracted towards the main body and the cavity is closed, and wherein the ejector is configured to eject the aerosol-generating article from the cavity during movement of the top cover from the first position to the second position.

2. Aerosol-generating device according to claim 1, wherein the movable top cover is slidably connected with the main body.

3. Aerosol-generating device according to claim 1, wherein the cavity comprises a heater.

4. Aerosol-generating device according to claim 1, wherein the aerosol-generating device further comprises at least one first biasing element being a first spring, for biasing the top cover towards the first position.

5. Aerosol-generating device according to claim 1, wherein the aerosol-generating device further comprises at least one protruding element attached to the top cover and accessibly arranged on the periphery of the aerosol-generating device for moving the top cover between the first and second position.

6. Aerosol-generating device according to claim 1, wherein the aerosol-generating device further comprises at least one second biasing element, being a second spring, for biasing the ejector towards the cavity.

7. Aerosol-generating device according to claim 1, wherein one or more of the top cover and the main body comprises a guiding element for guiding the movement of the top cover relative to the main body.

8. Aerosol-generating device according to claim 1, wherein the cavity comprises a heater, wherein the ejector comprises an opening, and wherein the opening is arranged such that the heater passes through the opening during movement of the top cover from the first position to the second position.

9. Aerosol-generating device according claim 8, wherein the ejector comprises a first cleaning element at least partially surrounding the opening for cleaning the heater when the heater passes through the opening.

10. Aerosol-generating device according to claim 1, wherein the ejector is configured to penetrate into the cavity during movement of the top cover from the first position to the second position.

11. Aerosol-generating device according to claim 10, wherein the ejector comprises a second cleaning element surrounding a proximal end of the ejector, and wherein the second cleaning element is arranged for cleaning the inner cavity wall during movement of the top cover from the first position to the second position.

12. Aerosol-generating device according to claim 1, wherein one or more of the top cover and the main body comprises a detector, preferably an electrical switch, configured to detect whether the top cover is in the first position or in the second position.

13. Aerosol-generating device according to claim 9, wherein one or more of the first cleaning element and the second cleaning element is also configured as a sealing element configured for sealing the cavity when the top cover is in the second position.

14. Aerosol-generating device according to claim 1, wherein the top cover or the ejector comprises an indicator configured to indicate when an aerosol-generating article is fully inserted into the cavity.

15. Aerosol-generating system comprising an aerosol-generating device according to claim 1 and an aerosol-generating article comprising aerosol-forming substrate.

* * * * *